US005107060A

United States Patent [19]

Yan

[11] Patent Number: 5,107,060

[45] Date of Patent: Apr. 21, 1992

[54] THERMAL CRACKING OF MERCURY-CONTAINING HYDROCARBON

[75] Inventor: Tsoung Y. Yan, Philadelphia, Pa.

[73] Assignee: Mobil Oil Corporation, Fairfax, Va.

[21] Appl. No.: 599,200

[22] Filed: Oct. 17, 1990

[51] Int. Cl.[5] ..... C10G 17/00; C10G 25/04

[52] U.S. Cl. ..... 585/823; 585/648; 585/652; 208/91; 208/253; 208/251 R

[58] Field of Search ..... 585/648, 652, 823; 208/91, 99

[56] References Cited

U.S. PATENT DOCUMENTS

| | | | |
|---|---|---|---|
| 4,094,777 | 6/1978 | Sugier et al. | 210/32 |
| 4,101,631 | 7/1978 | Ambrosini et al. | 423/210 |
| 4,474,896 | 10/1984 | Chao | 502/216 |
| 4,709,118 | 11/1987 | Yan | 585/820 |
| 4,892,567 | 1/1990 | Yan | 55/33 |
| 4,909,926 | 3/1990 | Yan | 208/253 |
| 4,950,480 | 8/1990 | Dusters et al. | 585/820 |
| 4,986,898 | 1/1991 | Torihata et al. | 585/823 |

FOREIGN PATENT DOCUMENTS

| | | | |
|---|---|---|---|
| 7515579 | 6/1979 | France . | |
| 0002873 | 1/1990 | Japan | 585/823 |

*Primary Examiner*—Helane Myers
*Attorney, Agent, or Firm*—Alexander J. McKillop; Charles J. Speciale

[57] ABSTRACT

A method is provided for high temperature conversion of mercutry-containing hydrocarbon feedstocks to produce a product stream with a negligible mercury level and to protect cryogenic heat exchangers from mercury damage. The feed is treated with adsorbent at high temperatures to remove up to 99% of the mercury. After high temperature conversion, the product stream is treated over a second adsorbent composition to remove any residual mercury and water before the product is cooled and collected.

22 Claims, No Drawings

THERMAL CRACKING OF MERCURY-CONTAINING HYDROCARBON

BACKGROUND OF THE INVENTION

The invention relates to a method to protect cryogenic heat exchangers when the products from high temperature conversion of mercury-containing hydrocarbon feeds are cooled. The invention relates also to a method for reducing mercury to negligible levels in thermal cracking product steams.

Thermal cracking is a process in which heat is used to crack hydrocarbon feedstock. Steam cracking is the thermal cracking and reforming of hydrocarbon feedstocks with steam, to light olefins, such as ethylene, propylene, butenes and butadienes, generally carried out at low pressure and high temperature for short residence times. Steam is used as a diluent to achieve a low hydrocarbon partial pressure resulting in high product yield.

After a hydrocarbon feedstock has been subjected to high temperature cracking conditions, the product effluent may be cooled, dried and liquified in a cryogenic heat exchanger. Heat exchangers are often made of aluminum which can form an amalgam with mercury resulting in corrosion and cracking of the heat exchanger. When the feedstock contains mercury or mercury compounds, the resulting product effluent is contaminated with mercury. If it is not removed, the mercury damages the aluminum components of the heat exchanger.

The amount of mercury in hydrocarbon feeds varies with the type and geological origin of feeds. Liquid condensates from natural gas fields in particular contain significant levels of mercury.

A number of methods have been developed for removing mercury from gases and liquids using compounds supported by an adsorbent mass. Methods of this type are described in U.S. Pat. Nos. 4,094,777, 4,101,631, 4,474,896, 4,709,118, 4,892,567, 4,909,926 and French Patent No. 75/15579.

U.S. Pat. No. 4,094,777 and the French Patent employ a metal or metal compound supported by an adsorbent mass such as alumina or silica-alumina.

U.S. Pat. No. 4,101,631 describes the removal of mercury vapor by contacting a gas stream at −40° to 100° C. with zeolitic molecular sieves containing elemental sulfur.

U.S. Pat. No. 4,474,896 discloses the use of polysulfide-containing adsorbent compositions to adsorb mercury from gaseous or liquid streams.

U.S. Pat. No. 4,709,118 describes removing mercury from hydrocarbon liquids or gas by contacting with a reduced milled mixture of bismuth or tin oxide and silica or alumina base.

U.S. Pat. No. 4,892,567 describes a method for the simultaneous removal of mercury and water from a hydrocarbon fluid by contacting the fluid with zeolite A containing elemental silver or gold on its surface. Among the above-listed patents, only U.S. Pat. No. 4,909,926 describes chemisorption of mercury in condensate at high temperatures. In the method described in U.S. Pat. No. 4,909,926, the adsorption temperature is kept high to discourage adsorption of heavy compounds and improve adsorption of mercury. The optimum adsorption temperature depends on the endpoint of the condensate. Although the high temperature adsorption is effective in removing mercury from hydrocarbon oil, in a high temperature cracking process, even very small residual amounts of mercury remaining after adsorption treatment are converted to mercury vapor which is potentially damaging to the environment and also highly capable of damaging aluminum heat exchangers. U.S. Pat. Nos. 4,892,567 and 4,909,926 are incorporated by reference herein in their entireties.

Although various methods for removing mercury from gases and liquids have been described, none suggests providing a backup method to insure that mercury in product steams is reduced to the most minimal levels to avoid damage to cryogenic heat exchangers and to the environment.

Accordingly it is an object of the invention to supply a method which provides a good margin of protection against the incursion of mercury to the aluminum heat exchanger in high temperature hydrocarbon conversion processes.

It is a further object of the invention to supply a method for reducing mercury to extremely low levels in the product streams resulting from the thermal cracking.

SUMMARY OF THE INVENTION

The invention is a process for high temperature conversion of hydrocarbon feedstock containing mercury which minimizes mercury contamination in product streams and minimizes damage to cryogenic aluminum heat exchangers used in the process. Heated feedstock is contacted with a first mercury-reactive adsorbent composition at 0–1000 psig, a liquid hourly space velocity of from about 0.05–100 and a temperature of from about 60° to 700° F. This first contacting produces an effluent with a substantially reduced mercury level. The effluent is subjected to thermal conversion conditions to produce a product stream in which any residual mercury is present as mercury vapor. To remove residual mercury, the product stream is cooled, and is contacted with a second mercury reactive adsorber composition to reduce simultaneously any residual mercury in the product stream to a level which minimizes mercury damage to cryogenic heat exchangers and the moisture to a level acceptable to the cryogenic heat exchangers. The contacted product stream can then be cooled and liquified in a cryogenic heat exchanger and the product collected for further processing.

Advantageously, the process offers flexibility in the choice of feedstock for high temperature conversion processes, to maximize the economics of the conversion process. Economically and logistically available feedstocks which contain high levels of mercury can be converted to enhance process economics without the danger of damaging the expensive processing equipment, and polluting the environment.

For a better understanding of the present invention, together with other and further objects, reference is made to the following description, and its scope will be pointed out in the appended claims.

DETAILED DESCRIPTION OF THE INVENTION

Hydrocarbon feeds, particularly liquid condensate from natural gas fields can contain significant levels of mercury. Typical crude oils contain about 0.5 to 10 ppb of mercury. In condensates from natural gas production, concentrations as high as between 50 and 300 ppb may be present. Condensate may be used for olefin production by steam pyrolysis which is a type of thermal cracking.

Thermal cracking is a process in which carbon-to-carbon bonds are severed through the action of heat. Besides the steam cracking of condensate, thermal cracking may comprise heating of any fraction of petroleum to a temperature at which substantial thermal decomposition takes place, followed by cooling, condensation and physical separation of the reaction products. A number of petroleum refinery processes based on thermal cracking differ primarily in the intensity of the thermal conditions and the feedstock. Some of these refinery processes are, for example, visbreaking carried out at about 850°-950° F. or 450°-510° C., naphtha cracking carried out at about 950°-1100° F. or 510°-600° C., steam cracking carried out at about 1100°-1400° F. or 590°-760° C., fluid coking, flexicoking and delayed coking. Feedstocks for thermal cracking may range from light gas to vacuum resid.

In a petrochemical complex, various feedstocks may be thermally cracked. The feedstocks include liquid condensate and crude oil fractions. In the petroleum refining process, crude oil is charged to an atmospheric distillation tower which separates the crude into cuts depending on the boiling point. Typical fractions in order of increasing boiling points are the light gases, i.e. dry gas, e.g. methane, ethane, some propane, and wet gas, e.g. propane, butane, some methane and ethane; light straight run gasoline, b.p. about 90°-420° F.; naphtha (heavy straight run gasoline) b.p. about 160°-420° F.; gas oils, b.p. about 330°-750° F., e.g. kerosene and light gas oils; heavy gas oils, b.p. about 550°-830°; and topped crude which is sent to the vacuum tower and separated into vacuum gas oil, b.p. about 800°-1050° F. and reduced crude bottoms (vacuum resid), b.p. above about 1000° F. The refining process is discussed in detail in *Petroleum Refining,* Gary, J. H. and Handwerk, G. E., published by Marcel Dekker, Inc., New York, N.Y. (1984).

In visbreaking, vacuum resid is converted to middle distillates and lighter material. In naphtha cracking or thermal gas oil cracking, heavy gas oils may be thermally cracked, although this fraction is usually fed to a catalytic cracker or hydrocracker. In fluid coking, flexicoking and delayed coking, vacuum resid is thermally cracked in the presence of coke to gas oil products and coke.

Steam cracking of hydrocarbon feeds produces olefins, hydrogen and light hydrocarbons by pyrolysis of saturated hydrocarbons derived, for example, from natural gas, liquid condensate or crude oil. Multicomponent hydrocarbon feedstocks such as the hydrocarbon condensates from natural gas production, natural gas liquids and naphthas and gas oils from crude oil may be used as feedstocks. Steam cracking is carried out at high temperatures up to 800°-850° C. and at a pressure slightly above atmospheric.

General reaction conditions for thermal cracking of hydrocarbon feedstock include a temperature of from about 300° C. to about 800° C. or 580°-1440° F., a pressure of from about 0.1 atmosphere (bar) to about 30 atmospheres and a weight hourly space velocity of from about 0.1 $hr^{-1}$ to about 20 $hr^{-1}$.

When the feedstock is subjected to thermal cracking conditions, the mercury compounds in the feedstocks are converted to mercury which is present in the gaseous products. As the gaseous product is cooled and liquified, the mercury attacks aluminum heat exchangers through liquid metal stress cracking and corrosion cracking leading to serious damage to the heat exchangers. In addition, mercury is an environmentally undesirable component in product streams.

Mercury in product streams and liquid metal cracking and corrosion cracking of aluminum heat exchangers in high temperature hydrocarbon conversion processes can be virtually eliminated by first treating the hydrocarbon feedstock with a reactive adsorbent to remove mercury through the formation of insoluble compounds. After subsequently cracking the treated feedstock to obtain gaseous products such as olefins, and before the gaseous product is subjected to cooling, the product stream is contacted with a composition comprising zeolite A and 0.001-15% elemental silver or gold treated to remove simultaneously any residual mercury and moisture to a level acceptable for the heat exchangers.

The process may be more particularly described as follows: In a pretreatment step before a hydrocarbon feed is subjected to cracking, the feed is heated to at least 200° F. and passed through a high temperature adsorption reactor at 0-1000 psig, 0.05 to 100 LHSV and at about 200° F. to 700° F. In this reactor is an adsorbent composition. Suitable adsorbents are copper, silver, iron, gold, bismuth or tin, as metals, oxides or sulfides. To form an adsorbent composition, the adsorbent is deposited on a support, for example, active carbon, alumina, silica-alumina, silica clay, zeolites, or other high surface area, high pore volume supports. In this high temperature adsorption step, 50 to 99% of the mercury in the feed is removed. The use of a high temperature adsorption results in high selectivity for mercury due to a reduction in the competitive adsorption of compounds in the feed and enhanced adsorption of mercury and mercury compounds. Adsorbents to be used in the pretreatment step, may be prepared according to the method described in U.S. Pat. No. 4,909,926. In a preferred embodiment, CuS is the adsorbent and the support is active carbon.

The first adsorption step may be conducted in vapor, vapor/liquid or liquid phase, but a homogeneous liquid or vapor phase is preferred for good distribution of the feed in the adsorption bed. Liquid phase is preferred for processing heavy carbon condensates. A high enough pressure is maintained to assure the feed is in liquid phase.

The first adsorber can be regenerated by raising the temperature in the presence of inert gases such as $N_2$, methane, ethane, natural gas, and $CO_2$. For more complete regeneration, the first adsorber is heated in the presence of oxygen and the oxygen is purged prior to reducing the temperature. Following the regeneration, sulfiding may be required when Cu/active carbon adsorbent is used.

In the first adsorption step, level of mercury in the feed is reduced to less that about 20 ppb.

In steam cracking the treated effluent emerging from the adsorption reactor is mixed with steam and fed into a steam cracking furnace. Residence times in the cracking zone are relatively brief, e.g., from about 0.3 to 0.8 seconds but the temperature is high, e.g. 1400°-1550° F. In this step, the pretreated effluent is cracked in the furnace to obtain olefinic products. Concurrently in the cracking process, however, residual mercury compounds remaining in the feed are converted into mercury vapor and exit the cracker along with the gaseous products. Although a substantial amount of mercury is removed from the feedstock in the initial adsorbent pretreatment, resulting in a low mercury content at this point, e.g., less than 1 ppb, the mercury content is still too high for aluminum heat exchangers to tolerate. Furthermore, an interruption or upset occurring in the operation of the high temperature adsorber can cause a spike in the mercury content thereby damaging the aluminum adsorber.

The gaseous cracker product, therefore, is advantageously subjected to a second mercury-removal treatment to remove water and residual mercury simultaneously before passage to a heat exchanger. In this second treatment step, the product is contacted with zeolite A adsorbent modified with mercury reacting materials to remove water and residual mercury simultaneously, resulting in a secondary effluent which contains cracking products and a substantially reduced mercury level. The secondary effluent has a mercury content lower than 0.1 ppb, preferably lower than 0.01 ppb. This effluent can be safely cooled and liquified in aluminum heat exchangers. The modified zeolite A adsorber can be regenerated by stripping off the adsorbed mercury and water using hot inert gas, natural gas or air.

For the second adsorption treatment, zeolite A sieves are modified with metals such as silver, gold, copper, tin, iron or bismuth in metallic or oxide forms, by impregnation, ion exchange, or physical mixing. The adsorbents for the second adsorption treatment may be prepared according to the method described in U.S. Pat. No. 4,892,567.

Through the use of a process which includes two separate and independent mercury removal steps, high temperature conversions of mercury-containing hydrocarbon feeds can be carried out without damage to expensive heat exchangers. In addition, the process increases feedstock flexibility leading to improved process economics.

While there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A process for high temperature conversion of a hydrocarbon feedstock containing mercury, which minimizes mercury contamination in a product stream comprising:

heating the feedstock to a temperature of at least 200° F.;

contacting the heated feedstock with a first adsorbent composition reactive with mercury in a high temperature adsorber reactor at 0 to 1000 psig, a liquid hourly space velocity of from about 0.05 to about 100, and a temperature of about 200° to 700° F. to produce an effluent feedstock with a substantially reduced mercury level;

thermally converting the effluent feedstock under thermal conversion conditions to produce a product stream;

contacting the product stream with a second adsorber composition reactive with mercury to remove water and reduce any residual mercury in the product stream to a negligible level below about 1 ppb, producing a contacted product stream;

cooling the contacted product stream; and collecting the product.

2. The process of claim 1 wherein the feedstock is selected from the group consisting of crude oil and cuts thereof.

3. The process of claim 1 wherein the feedstock is naphtha.

4. The process of claim 1 wherein the feedstock is a light hydrocarbon selected from the group consisting of ethane, propane, butane and pentane.

5. The process of claim 1 wherein the hydrocarbon feedstock is a condensate from natural gas production.

6. The process of claim 1 wherein the hydrocarbon feedstock is in liquid form and the product stream is in gaseous form.

7. The process of claim 1 wherein the thermal conversion is steam cracking.

8. The process of claim 1 wherein the contacting with the first adsorbent composition is at a temperature of from about 300° to about 700° F.

9. The process of claim 1 wherein mercury removal is from about 50 to about 99% in the contacting with the first adsorbent composition.

10. The process of claim 1 wherein the mercury removal is from about 95 to about 99% in the contacting with the first adsorbent composition.

11. The process of claim 1 wherein the first adsorbent composition comprises a first reactive adsorbent and a support having a high surface area.

12. The process of claim 11 wherein the first reactive adsorbent is selected from the group consisting of copper, gold, silver, iron, bismuth and tin, as metals, oxides and sulfides.

13. The process of claim 11 wherein the support is selected from the group consisting of active carbon, alumina, silica-alumina, silica, clay and zeolites.

14. The process of claim 11 wherein the first reactive adsorbent is CuS and the support is active carbon.

15. The process of claim 1 wherein the second adsorbent composition comprises a zeolite A containing a metal.

16. The process of claim 15 wherein the metal is selected from the group consisting of silver, gold, copper, tin, iron and bismuth, as metals, sulfides and oxides.

17. The process of claim 16 wherein the metal is deposited on the zeolite A by a method selected from the group consisting of impregnation, ion exchange and physical mixing.

18. The process of claim 16 wherein the zeolite A is zeolite 4A, the metal is silver and the metal is deposited on the zeolite 4A by impregnation.

19. The process of claim 16 wherein the metal is present in an amount of from about 0.001 to about 15% by weight.

20. The process of claim 1 wherein the mercury in the contacted product stream is below about 0.1 ppb.

21. The process of claim 1 wherein the mercury in the contacted product stream is below about 0.01 ppb.

22. A process for steam cracking of a hydrocarbon condensate containing mercury, while minimizing mercury damage to a cryogenic heat exchanger used in the process, comprising heating the condensate to a temperature of from about 400° F. to 600° F.;

contacting the heated condensate with a first adsorber composition comprising a first reactive adsorbent reactive to mercury and selected from the group consisting of Ag, Au, CuO and CuS and a support having a high surface area, to produce an effluent with a reduced mercury level;

steam cracking the effluent under steam cracking conditions to produce a gaseous product stream;

contacting the gaseous product stream with a second adsorbent composition reactive with mercury comprising a zeolite A containing about 0.001-1% elemental silver, thereby removing water and reducing any residual mercury in the product stream to a level which minimizes mercury damage to cryogenic heat exchangers;

cooling the contacted product in the cryogenic exchanger; and collecting the product.

* * * * *